US009605639B2

(12) United States Patent
Berkemeier et al.

(10) Patent No.: US 9,605,639 B2
(45) Date of Patent: Mar. 28, 2017

(54) FUEL INJECTOR

(71) Applicant: Ford Global Technologies, LLC, Dearborn, MI (US)

(72) Inventors: Oliver Berkemeier, Bergisch Gladbach (DE); Robin Ivo Lawther, Chelmsford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 363 days.

(21) Appl. No.: 13/922,076

(22) Filed: Jun. 19, 2013

(65) Prior Publication Data

US 2014/0014067 A1 Jan. 16, 2014

(30) Foreign Application Priority Data

Jul. 12, 2012 (DE) ..... 10 2012 212 177

(51) Int. Cl.

| | |
|---|---|
| ***F02B 3/00*** | (2006.01) |
| ***F02M 55/02*** | (2006.01) |
| ***F02M 51/00*** | (2006.01) |
| ***F02M 69/04*** | (2006.01) |
| ***F02M 45/08*** | (2006.01) |
| ***F02M 45/12*** | (2006.01) |
| ***F02M 51/06*** | (2006.01) |
| ***F02M 61/08*** | (2006.01) |
| ***F02M 61/16*** | (2006.01) |
| ***F02D 41/30*** | (2006.01) |
| *F02D 41/20* | (2006.01) |

(52) U.S. Cl.

CPC ..... *F02M 69/04* (2013.01); *F02D 41/3005* (2013.01); *F02M 45/08* (2013.01); *F02M 45/086* (2013.01); *F02M 45/12* (2013.01); *F02M 51/0617* (2013.01); *F02M 61/08* (2013.01); *F02M 61/161* (2013.01); *F02D 2041/2079* (2013.01)

(58) Field of Classification Search

CPC ..... F02M 69/044; F02M 57/04; F02D 1/00; F02D 9/00; F01L 3/20; F02B 3/06

USPC ..... 123/445, 296

See application file for complete search history.

(56) References Cited

U.S. PATENT DOCUMENTS

| | | | | |
|---|---|---|---|---|
| 5,141,164 | A | 8/1992 | Ohno et al. | |
| 6,378,503 | B1 * | 4/2002 | Lambert | F02M 45/086 123/468 |

(Continued)

FOREIGN PATENT DOCUMENTS

| | | | |
|---|---|---|---|
| DE | 3041018 | A1 | 5/1982 |
| DE | 10061571 | A1 | 6/2002 |

(Continued)

*Primary Examiner* — Lindsay Low
*Assistant Examiner* — Syed O Hasan
(74) *Attorney, Agent, or Firm* — Julia Voutyras; John D. Russell; B. Anna McCoy

(57) ABSTRACT

Various embodiments relating to controlling a fuel injection quantity of a fuel injector are provided. In one embodiment, a fuel injector for an internal combustion engine includes a fuel supply channel, a nozzle valve including a valve stem, and an actuator to actuate the nozzle valve. The nozzle valve and an inner wall of the fuel supply channel form a first flow cross section and at least one second flow cross section that is greater than the first flow cross section.

19 Claims, 3 Drawing Sheets

(56) References Cited

U.S. PATENT DOCUMENTS

| | | | | |
|---|---|---|---|---|
| 6,478,013 | B1 * | 11/2002 | Boecking | F02D 41/2096 123/467 |
| 2004/0195385 | A1 * | 10/2004 | Lawrence | F02M 45/086 239/533.2 |
| 2005/0098144 | A1 * | 5/2005 | Stewart | F02B 1/12 123/299 |
| 2006/0157594 | A1 * | 7/2006 | Cooke | F02M 45/086 239/533.11 |
| 2008/0308064 | A1 * | 12/2008 | Yudanov | F02M 45/02 123/296 |

FOREIGN PATENT DOCUMENTS

| | | | |
|---|---|---|---|
| DE | 10249287 | A1 | 5/2004 |
| EP | 0240693 | B1 | 12/1990 |
| EP | 1676997 | A1 | 7/2006 |
| WO | 9403720 | A1 | 2/1994 |
| WO | 2006005167 | A1 | 1/2006 |

* cited by examiner

FUEL INJECTOR

CROSS REFERENCE TO RELATED APPLICATIONS

The present application claims priority to German Patent Application No. 102012212177.3, filed on Jul. 12, 2012, the entire contents of which are hereby incorporated by reference for all purposes.

FIELD

The present disclosure relates to a fuel injector for internal combustion engines, in particular for use in gasoline or diesel combustion engines.

BACKGROUND AND SUMMARY

Fuel injectors are used to inject fuel into the combustion chambers or intake tracts of internal combustion engines, in particular gasoline or diesel engines. Their purpose is to spray out, within a short available time period, a precisely measured quantity of fuel under high pressure, and to close the injector or nozzle cleanly. The fuel quantity may be varied in an adequately dimensioned quantity range depending on the load and rotation speed, and follows dynamic load changes temporally. The metering of the fuel quantity injected can be predefined in a so-called ballistic injector mode in which the valve assumes an intermediate position between a closed position and a full-stroke injector mode. Another way of predefining the fuel quantity is to predefine the opening time in full-stroke injector mode. At low speeds and loads therefore, very small fuel quantities may be metered and also atomized reliably. Further, fuel may be metered with little noise during the injection process, in order to limit the noise emissions of the engine. Often a so-called choke ring gap is used to meter small fuel quantities. Another approach includes a damper device in the leakage fuel line which, by slowing the outflow of fuel, damps the movement of the needle valve which thus achieves a low opening degree.

DE 3041018 A1 discloses an injector nozzle configuration including a needle valve that may be opened by a high pressure pulse of fuel. A choke valve is fitted in the housing of the injector nozzle between a pressure chamber and a spring chamber. This approach has less delay than the above-mentioned approach, but here the dynamics and precision of fuel quantity control can lead to increased fuel consumption and power losses. In particular, this choke device cannot be controlled in a targeted fashion, and an optimum fuel quantity may not be supplied for all operating load types of the combustion engine.

EP 0240693 B1 discloses an injector nozzle configuration where travel of a needle valve can be limited by an end stop, and a damping stop can be positioned in-between to reduce end stop noise. A pre-injection phase and a main injection phase may be performed, to which a pre-stroke and a main stroke of the valve are allocated, in order to achieve lower combustion noise. In the pre-stroke phase, the fuel pressure need merely overcome the closing force of the return spring. Further, lifting of the needle valve meets an additional resistance from the (lower) fuel pressure behind an additional auxiliary piston which presses on the valve.

WO 94/03720 A1 discloses an approach acting in a similar manner to that described above, and is intended primarily to reduce combustion noise by a pre-stroke valve phase.

Furthermore, to regulate fuel pressure more finely, firstly generally high requirements may be imposed on the actual injection pump control. Therefore, injection systems have also been developed with a common high pressure accumulator, for example known as a common rail. These can be fed with a simpler high pressure pump and the injector phases and quantities are controlled by actuating means, normally electromechanical, which are positioned in each injection nozzle and controlled by a normally electronic controller. Such common rail configurations typically may be fitted with the injector nozzles described above.

However, the inventors herein have identified some potential issues with all of these approaches. For example, in each approach, a dynamic working range (DWR) of the injection nozzle is too small, and the accuracy of the fuel quantity control, particularly in low and high fuel flow phases, may not be suitable. In particular, the above described approaches may not differentiate sufficiently precisely between the control phases of small and large fuel quantities. Such imprecise fuel metering may increase fuel consumption at engine idle speeds, as well as decrease working efficiency in all load situations.

Thus, in one example, some of the above issues may be at least partly addressed by a fuel injector for an internal combustion engine, including a fuel supply channel, a nozzle valve including a valve stem. The nozzle valve and an inner wall of the fuel supply channel may form a first flow cross section and at least one second flow cross section that is larger than the first flow cross section. The fuel injector may further include an actuator to actuate the nozzle valve.

This two stage fuel injector may meter fuel very precisely during low flow operational points by positioning the nozzle valve in a first flow cross section region having a first smaller flow cross section. Further, as fuel flow demand increases, the nozzle valve may be positioned in a second flow cross section region having a second larger flow cross section that is greater than the first flow cross section to achieve flow that meets the demands across the operation range of the engine. In this way, the fuel injector may provide precisely metered fuel during low flow conditions, while meeting peak demand during high flow conditions. In other words, the dynamic flow control range of the fuel injector may be increased relative to prior configurations. Moreover, sufficient differentiation between a low fuel flow and high fuel flow may be realized, and a dependency on viscosity of fuel to provide accurate metering may be reduced.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

BRIEF DESCRIPTION OF THE DRAWINGS

The subject matter of the present disclosure will be better understood from reading the following detailed description of non-limiting embodiments, with reference to the attached drawings, wherein.

DETAILED DESCRIPTION

Figure 1:
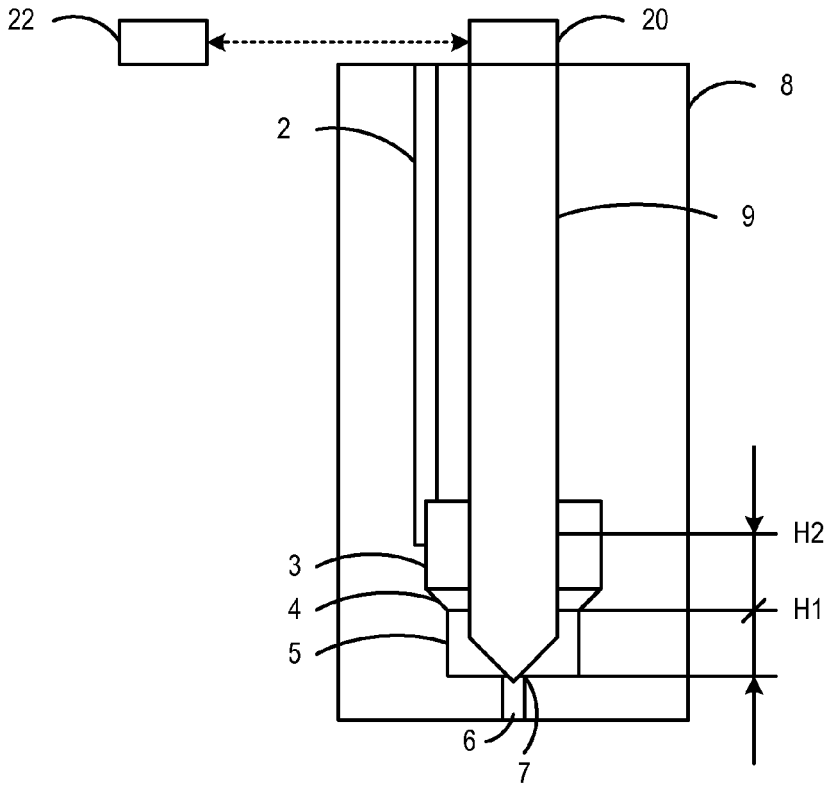
FIG. 1 shows a diagrammatic cross section view of a fuel injector in a closed operating position according to a first embodiment of the present disclosure.

Various systems and methods are provided for controlling a fuel injection quantity of a fuel injector. More particularly, the present description relates to a fuel injector that includes a two stage opening that releases fuel according to a low flow stage and high flow stage, realized hydraulically, mechanically, or electronically. In particular, the fuel injector may include a first flow cross section region having a first flow cross section to meter fuel precisely during low fuel flow conditions. Further the fuel injector may include a second flow cross section region having a second cross section that is larger than the first cross section to meter fuel precisely during high fuel flow conditions up to and including maximum fuel throughput. In this way, the dynamic flow control range of the fuel injector may be increased relative to prior configurations.

It should be pointed out that the features listed individually in the description which follows can be combined in any arbitrary, technically sensible manner and constitute further embodiments of the present disclosure. In the different figures, the same parts may carry the same reference numerals so these are usually only described once.

FIG. 1 shows a diagrammatic side cross section view of a first embodiment of a fuel injector 1 according to the present disclosure. The fuel injector 1 may be configured as an inwardly opening injector, and is shown in a closed operating position. The fuel injector 1 includes a housing 8. In the housing 8 may be provided a fuel supply channel 2 for the supply of a fuel under a predefined or predefinable pressure. The fuel supply channel 2 opens into a nozzle opening 6 which is closed by a nozzle valve 7 via a valve stem 9 under the effect of force from a reset element. In the illustrated embodiment, the closing surface of the nozzle valve is conical. This shape is merely shown as an example, and it is to be understood that the closing surface may take other forms. As another example, the closing surface of the nozzle valve may take a spherical form.

The nozzle valve 7 has a linear valve stem 9 which is guided in a guide bore formed in the housing 8, wherein vertical movements (viewed in the drawing plane) are possible. The housing 8 is shown highly diagrammatically merely as an example as one piece, and evidently practical designs may require division of the housing so that assembly can be achieved.

In the illustrated embodiment, the fuel supply channel 2 does not have a constant cross section, but forms a first flow cross section in a first flow cross section region 5 and a second flow cross section in a second flow cross section region 3. The first and second cross sections are formed between an inner wall of the fuel supply channel 2 and the valve stem 9 of the nozzle valve 7. The second flow cross section is greater than the first flow cross section, and thus the second flow cross section region 3 is larger than the first flow cross section region 5. In the present example, the second flow cross section region continues with the same cross section over a predefined length up to a step 4. The step may be formed by a protrusion or constriction. After the step 4, the fuel supply channel has a smaller predefined cross section and extends over a first smaller flow cross section region 5 until it constricts again into the nozzle opening 6.

By use of an actuator 20 which can be implemented in many ways, the nozzle valve 7 can be moved, preferably raised, vertically (viewed in the drawing plane) via the valve stem 9 against the force effect of a reset element (e.g., a return spring). For example, the actuator 20 may include a high pressure fuel system that hydraulically actuates the fuel nozzle valve by varying fuel pressure. As another example, the nozzle valve may be actuated mechanically, electromechanically or electronically by the actuator 20, and the actuator may be controlled by an electrical signal provided from a controller 22. In such configurations, an injector system may have a substantially constant fuel pressure.

The actuator may allow a differentiated lift of the nozzle valve 7 in two stroke positions shown in FIG. 1 as H1 and H2. During a shortened stroke or part stroke where the nozzle valve is positioned at H1, the fuel meets the first smaller flow cross section region 5 with its higher hydraulic flow resistance, which limits the fuel quantity which can be sprayed out of the nozzle during the only partial opening of the nozzle valve 7 for a predefined time period.

If a larger fuel quantity is required per injection process, the actuator 20 positions the nozzle valve 7 up to the predefined maximum stroke, the full stroke at H2. During a full stroke at H2, the fuel meets the second larger flow cross section region 3 with its correspondingly smaller hydraulic flow resistance, which thus increases the maximum fuel quantity which can be sprayed out of the nozzle during the full opening of the nozzle valve 7 for a predefined time period. By positioning the nozzle valve in the first region during lower flow conditions, and positioning the nozzle valve in the second larger region during higher flow conditions, the dynamic working range of the fuel injector may be significantly wider relative to fuel injector configurations that have a single cross section region. As a result smaller fuel quantities can be implemented, for example for idle or at low engine loads, very much more precisely by operation of the nozzle valve 7 in the shortened stroke at H1, and large fuel quantities for example on full load or full acceleration more quickly and efficiently by operating the nozzle valve 7 close to or in the maximum stroke H2.

In some embodiments, the actuator 20 may include an additional stroke limiting device to limit a stroke travel of the nozzle valve to the shortened stroke or part stroke. The stroke limiting device may be formed such that, by means of a force acting hydraulically by back-pressure on a surface of the valve nozzle, it increases the fuel pressure necessary to raise the nozzle valve so that an injector pump device which is regulated by fuel pressure can, by a lower pressure, control the position range of the part stroke differently from the position range of the maximum stroke or full stroke. For example the additional stroke limitation device is provided such that an auxiliary piston between an impact surface of the nozzle valve and a reset element is subjected to the hydraulic pressure force from a low pressure tract.

In one example, the stroke limiting device may include a surface of the nozzle valve configured to accept a force acting hydraulically by back-pressure of fuel in the fuel supply channel, the surface being shaped to cause an increase in fuel pressure against the surface to raise the nozzle valve. An injector pump device may be regulated by fuel pressure to, by a lower pressure, control a position range of a part stroke of the nozzle valve differently from a position range of a full stroke of the nozzle valve.

In some embodiments, the additional stroke limiting device can be formed as a mechanical, electromechanical or electronic additional actuating device which exerts force independently of fuel pressure and is controlled by a controller. Such devices are able to control in a targeted manner the position range of the shortened stroke or part stroke differently from the position range of the maximum stroke or full stroke, so that a substantially constant high fuel pressure from a common high pressure accumulator can be processed. This embodiment thus allows the use of the fuel injector in the now widely used and advantageous common rail injection system.

In one example, a stroke limiting device may include a mechanical, electromechanical or electronic actuating device that exerts force independent of fuel pressure to adjust the nozzle valve. A controller may be configured to control the actuating device to control a position range of a part stroke of the nozzle valve differently from a position range of a full stroke of the nozzle valve.

In some embodiments, depending on the control method used and the type of actuator used in each of the two phases, the fuel injector 1 can be operated ballistically in both the shortened stroke H1 and in the full stroke H2, or with full stroke operation by an optional stop at each stroke position H1 and H2. Also, a ballistic operation of the nozzle valve 7 can be carried out without intermediate stop at the shortened stroke position H1. In this way, the fuel injector allows a flexible structuring of the operating process over a dynamic flow control range which can be made significantly wider.

In one example, the fuel injector 1 for internal combustion engines, in particular for diesel or gasoline combustion engines, has a housing with a fuel supply channel which opens into a nozzle opening, a nozzle valve with a valve stem which with the inner wall of the fuel supply channel forms a flow cross section, wherein the nozzle valve closes or opens the nozzle opening, an actuating means to actuate the nozzle valve, and a reset element acting on the nozzle valve, in particular a return spring. Furthermore a full-stroke limitation of the full stroke or maximum stroke of the nozzle valve and an additional stroke limitation device acting in-between for a shortened stroke, i.e. a part stroke of the nozzle valve, can be provided.

The dynamic working range of the fuel injector 1 is widened particularly effectively in comparison with configurations having a single cross section. In one example, the valve stem of the nozzle valve and/or the inner wall of the fuel supply channel forms at least two flow cross sections, in particular by a constriction and/or a step formed as a recess and/or as a protrusion, i.e. forms a first smaller and a second larger flow cross section. Thus, at a low opening degree of the nozzle valve, the first smaller flow cross section region limits the fuel flow. When the nozzle valve is opened further, the second larger flow cross section region allows a greater fuel flow. The size and form of the cross section areas of the at least two flow cross section regions therefore constitute a simple construction for adjusting the dynamics of the fuel flow as desired. Also, more than two (e.g., three or four or more) flow cross sections can be provided in the fuel injector. Moreover, in the illustrated embodiment, because the first smaller flow cross section is formed in the position range of the part stroke and the second larger flow cross section is formed in the position range of the full stroke of the nozzle valve, flow of fuel achieves two different dynamic curves for small and large fuel injection quantities.

Figure 2:
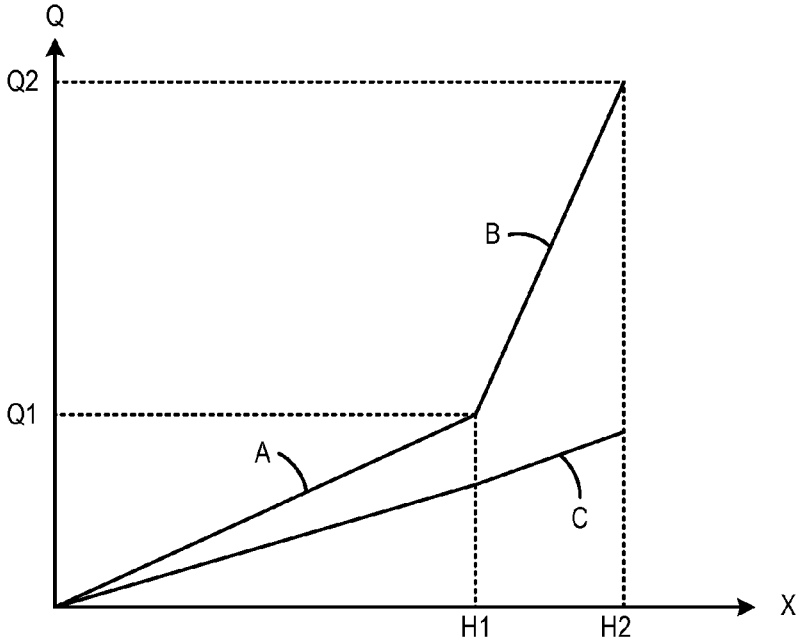
FIG. 2 shows an idealized curve of fuel quantity throughput and hydraulic flow resistance depending on a stroke position of a nozzle valve of a fuel injector according an embodiment of the present disclosure.

FIG. 2 shows an idealized curve of the fuel quantity throughput and hydraulic flow resistance depending on the stroke position of a nozzle valve of a fuel injector according to an embodiment of the present disclosure. The axis X represents the stroke height of the nozzle valve and the axis Q represents the effective fuel passage cross section which behaves proportionally to fuel quantity throughput and hydraulic flow resistance.

In a highly idealized manner, it is clear that during the shortened stroke phase or part stroke H1, a flatter first curve segment A with its low gradient depicts a smaller effective fuel passage cross section Q1. After passing stroke position H1, the curve transforms into the second curve segment B and rapidly becomes steeper, thus depicting a significantly enlarging effective fuel flow cross section Q2. By specifying the ratio and absolute vales of both cross sections, the required control dynamic and width can be predefined. A second idealized curve C, in comparison with the curve segments A and B, shows a smaller dynamic working range of conventional fuel injectors that do not have two different flow cross section regions.

In some embodiments, the transition from cross section Q1 to Q2 at the stroke positions H1, H2 and the valve seat, instead of an abrupt transition at the step 4, can be formed continuous, as shown for example conical. The size of the nozzle opening 6 is evidently predefined so that it allows the maximum fuel throughput in the full stroke position H2.

Figure 3:
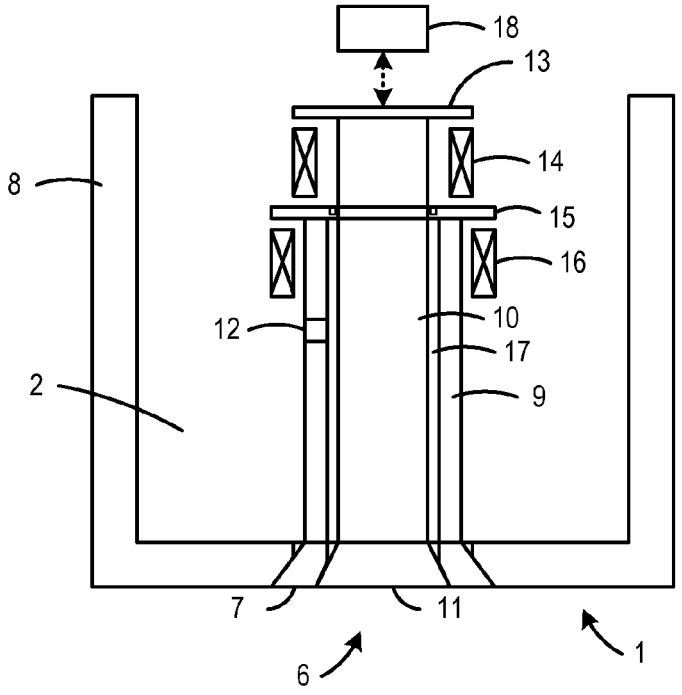
FIG. 3 shows a diagrammatic cross section view of a fuel injector in a closed operating position according to a second embodiment of the present disclosure.

FIG. 3 depicts a diagrammatic side cross section view of a second embodiment of a fuel injector 1 according to the present disclosure. The fuel injector 1 is shown in a closed operating position. In this embodiment, the flow cross sections (i.e., the first smaller flow cross section 5 and the second larger flow cross section 3), are implemented by two nozzle valves which each have a smaller and a larger valve seat.

In this embodiment, both valves are formed opening outward, although it should be noted that also an inwardly opening design is conceivable without departing from the scope of the present disclosure. Outward opening here means that in order to open, the valve is moved outward from its valve seat out of the housing of the nozzle valve. An inwardly opening valve in contrast is described in FIG. 1, where in order to open, the valve is drawn into the interior of the housing.

The first nozzle valve 7 is formed as an outer valve with valve stem 9, outwardly opening in nozzle opening 6 of the housing 8, in a closed state is held by a reset element, for example a pre-tensioned spring, tightly sealed in its valve seat formed in the nozzle opening 6. The second nozzle valve is formed as an inner valve 11 with valve stem 10 and is arranged moveably in a cavity 17 formed in the nozzle valve 7. The cavity 17 is dimensioned such that a predefined distance, and hence a flow cross section, is formed between the inner wall of the cavity 17 and the valve stem 10. Thus, an additional fuel supply channel 17 is created for the inner valve which for example is connected via at least one opening 12 in the upper region of the nozzle valve to the main fuel supply channel 2 so that the fuel can flow into this intermediate space and through it when the inner valve 11 is opened.

The cross section of the fuel supply channel 17 thus created in the cavity may correspond to the first small flow cross section region having the first cross section. In some cases, the first small flow cross section can be created after opening of the inner valve 11 as a flow cross section 5 (shown in FIG. 4). In both cases, either the relatively narrowly formed fuel supply channel 17 and/or the opened inner valve 11 creates a predefined first higher flow resistance which is designed for finely metered supply of fuel in small throughput quantities during idling or at low load.

Figure 4:
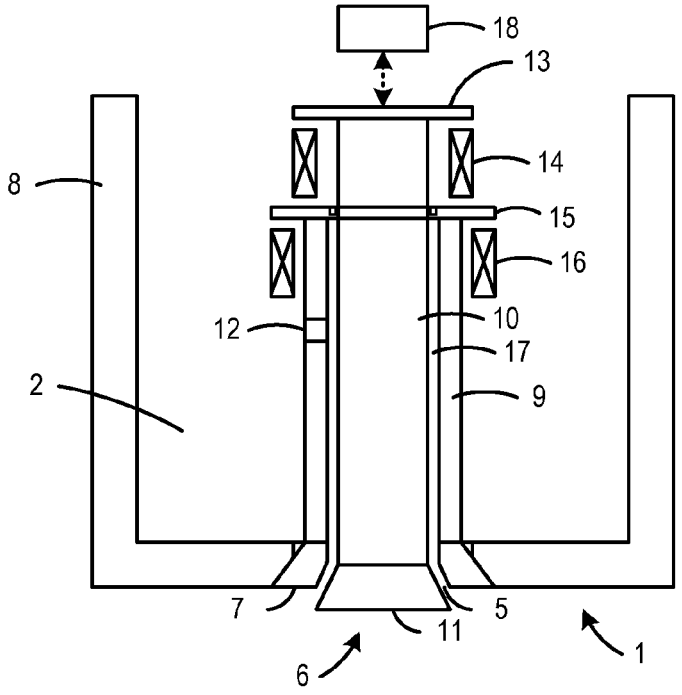
FIG. 4 shows a diagrammatic cross section view of the fuel injector of FIG. 3 in a partly opened operating position.

FIG. 4 shows a diagrammatic side cross section view of the second embodiment of the fuel injector from FIG. 3 in a partly opened operating position. To actuate the inner valve 11 with the valve stem 10, here a solenoid actuator 14 is provided merely, as an example, which exerts a force and acts electromagnetically on a ferrous disk 13, applied by form fit or formed on the end of the valve stem 10, when an electric control current is connected by a controller 18. The force generated presses the valve stem 10 against the closing force of a reset element, overcomes this force and opens the inner valve 11. The inner valve can be operated both in ballistic mode and in full-stroke mode by the controller 18.

The solenoid actuator 14 can be connected by force fit with the housing 8 of the fuel injector 1 so that the force it exerts can be transmitted to the valve stem 10. For reasons of simpler depiction, these fixing details are not shown in FIGS. 3 to 5.

Figure 5:
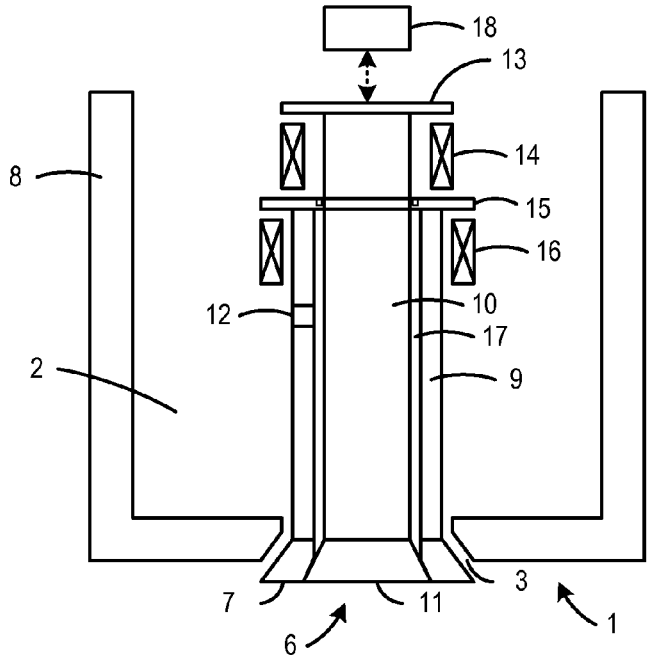
FIG. 5 shows a diagrammatic cross section view of the fuel injector of FIG. 3 in a fully opened operating position.

FIG. 5 is a diagrammatic side cross section view of the second embodiment of the fuel injector from FIGS. 3 and 4, in a fully opened operating position. For operation in this position, a current flows through an actuator 16, for example a solenoid, which generates an attraction force on a ferrous disk 15 of the nozzle valve 7 with valve stem 9. This solenoid actuator 16 as described above is rigidly connected with the housing 8 in a manner not shown for a sake of simplicity. The solenoid actuator 16 may be controlled by the controller 18.

In the open operating position of the main nozzle valve 7, the second larger flow cross section or cross section region 3 may be formed between the inner wall of the nozzle opening 6 and the fuel supply channel 2. The inner valve 11 is hereby closed if the stroke heights of both valves are selected the same, as is the case here merely as an example. In further embodiments however operating positions with both valves open can be achieved. In this operating position, an open fuel supply channel is formed between the fuel supply channel 2 and the second larger cross section 3.

As the diameter of the outer nozzle valve 7 for constructional reasons may be greater than the diameter of the inner valve 11, it is also easy to implement a significantly larger flow cross section Q2. By means of this larger flow cross section Q2, a significantly greater fuel throughput is possible which, for full-load operating phases, allows a very rapid supply of fuel with more precise dynamics relative to previous fuel injector configurations.

According to the above described embodiment, for smaller fuel quantities a finer control, and for large to maximum fuel quantities a coarser, faster control can be applied. Switching between the two operating positions in this embodiment preferably takes place largely independently of the other valve and with very short stroke heights. By means of a larger dynamic working range, influences of differing viscosity of the fuel due to temperature or fuel quality can be compensated by control parameters of the injection controller.

In some embodiments, the fuel injector according to the present disclosure may be employed in a combustion engine of a vehicle, in particular a motor vehicle, here preferably in a diesel or gasoline combustion engine.

In a further embodiment of the fuel injector according to the present disclosure, the nozzle valve is formed with a cavity which passes through its longitudinal axis and in which an additional moveable inner valve is positioned, wherein the cavity forms an additional segment of the fuel supply channel. With this further example embodiment, the desired increase in dynamic response of the fuel injector according to the present disclosure can be further increased in comparison with previous fuel injector configurations. This improvement occurs because the stroke heights of the two valves can be designed very short, so that the inert masses of the valves move over a shorter travel, which evidently can take place more quickly. Also, the construction length of the fuel injector can be designed shorter. Because the two valves can be controlled separately, the two operating modes for small and large fuel quantities can be controlled even more precisely differentiated from each other than in the embodiments described above.

In some embodiments, the inner valve with the inner wall of the cavity forms the first smaller flow cross section, and the nozzle valve with the inner wall of the fuel supply channel forms the second larger flow cross section. The nozzle valve and the inner valve can be formed either as outwardly opening or inwardly opening valves. In some embodiments furthermore the actuator for actuating the nozzle valve can be formed optionally hydraulically by fuel pressure or mechanically, electromechanically and/or electronically.

According to a further embodiment, with the first smaller flow cross section region a first dynamic curve may be predefined or linked by forming for finely metered supply of very small fuel quantities, and with the second larger flow cross section region, a second dynamic curve for metered supply of larger to maximum fuel quantities per injection process. It is thus possible to predefine the desired dynamic behavior of the system with two curves that can be designed according to engine operation requirements.

In one example, the fuel injector comprises a first nozzle valve having a first flow cross section, and a second nozzle valve having a second flow cross section greater than the first flow cross section. The second nozzle valve may form a cavity that passes through a longitudinal axis of the second nozzle valve, and the first nozzle valve may be positioned within the cavity. The fuel injector may further comprise a first actuator to actuate the first valve nozzle independent of the second nozzle, and a second actuator to actuate the second valve nozzle. The first nozzle valve and the second valve may be formed as outwardly opening valves.

In some embodiments, fuel is supplied from a preferably common high pressure accumulator, in particular a common rail, via the fuel supply channel.

The configurations illustrated above enable various methods for controlling a fuel injection quantity of a fuel injector in an engine of a motor vehicle. Accordingly, some such methods are now described, by way of example, with continued reference to above configurations. It will be understood, however, that these methods, and others fully within the scope of the present disclosure, may be enabled via other configurations as well.

Figure 6:
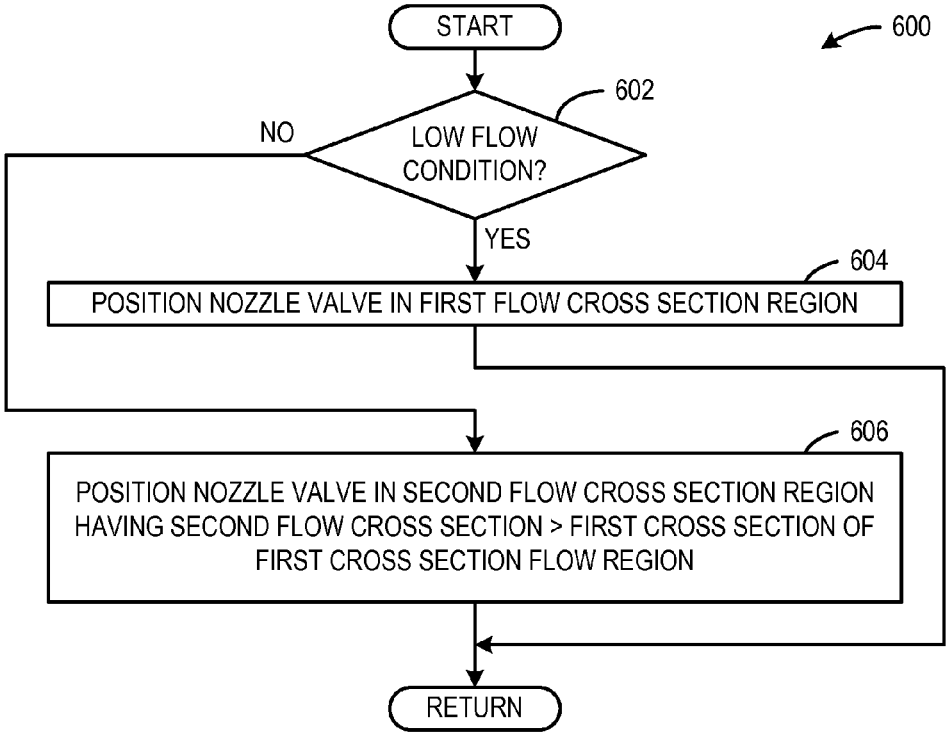
FIG. 6 shows an embodiment of a method for controlling a fuel injection quantity of a fuel injector according to an embodiment of the present disclosure.

FIG. 6 shows an embodiment of a method 600 for controlling a fuel injection quantity of a fuel injector according to an embodiment of the present disclosure. For example, the method 600 may be performed by the controller 11 shown in FIG. 1. As another example, the method 600 may be performed by the controller 18 shown in FIGS. 3-5.

At 602, the method 600 may include determining a low flow condition. For example, a low flow condition may include engine operating conditions where a smaller quantity of fuel is required to be injected to meet engine output demand. For example, a low flow condition may include an engine idle speed condition. In one example, the low flow condition may be determined based on engine speed. It is to be understood that a suitable engine operating parameter may be used to determine the low flow condition without departing from the present disclosure. If it is determined that there is a low flow condition, then the method 600 moves to 604. Otherwise, the method 600 moves to 606.

At 604, the method 600 may include positioning a nozzle valve of the fuel injector in a first flow cross section region having a first cross section to provide a first fuel injection quantity. In one example, the first flow cross section region may be formed between an inner wall of a fuel supply channel and a valve stem of the nozzle valve. Further, the nozzle valve may be adjusted by a partial stroke to position the nozzle valve in the first flow cross section region. In another example, the nozzle valve may include an inner nozzle valve and an outer nozzle valve, and the nozzle valve maybe positioned in the first flow cross section region by actuating the inner valve of the nozzle valve.

At 606, the method 600 may include positioning the nozzle valve in a second flow cross section region having a second cross section greater than the first cross section to provide a second fuel injection quantity greater than the first fuel injection quantity. In one example, the second flow cross section region may be formed between an inner wall of a fuel supply channel and a valve stem of the nozzle valve. Further, the first flow cross section and the second flow cross section may be predefined by a step formed between the valve stem of the nozzle valve and the inner wall of the fuel supply channel. For example, the nozzle valve may be adjusted by a full stroke to position the nozzle valve in the second flow cross section region. In another example, the nozzle valve may include an inner nozzle valve and an outer nozzle valve, and the nozzle valve maybe positioned in the second flow cross section region by actuating the at least the outer valve of the nozzle valve. Further, in some embodiments, both the inner valve and the outer valve may be actuated to position the nozzle valve in the second flow cross section region. For example, the inner valve and/or the outer valve may be actuated hydraulically by fuel pressure or mechanically, electromechanically and/or electronically via an actuator.

In one example, the nozzle valve may be positioned in the first flow cross section region in response to a lower fuel flow condition. Further, the nozzle valve may be positioned in the second cross section region in response to a higher fuel flow condition. For example, the higher fuel flow condition may be defined by flow demand that is greater than a threshold value that may be used to determine whether to position the nozzle valve in the first or second flow cross section region.

In one example, a method for controlling the fuel injection quantity of a fuel injector according to any of the example embodiments described above, i.e. a fuel injector which opens inwardly or outwardly. This is achieved in that the determination of the fuel quantity to be predefined per injection process takes into account a reduced cross section and flow region at least in the position range of the shortened stroke i.e. the part stroke, and an enlarged cross section and flow region at least in the position range of the maximum stroke i.e. the full stroke.

As well as the advantages of more efficient and dynamic fuel injection, the fuel injector according to the present disclosure and the method can also advantageously be used to reduce combustion noise.

It will be understood that the example control and estimation routines disclosed herein may be used with various system configurations. These routines may represent one or more different processing strategies such as event-driven, interrupt-driven, multi-tasking, multi-threading, and the like. As such, the disclosed process steps (operations, functions, and/or acts) may represent code to be programmed into computer readable storage medium in an electronic control system.

It will be understood that some of the process steps described and/or illustrated herein may in some embodiments be omitted without departing from the scope of this disclosure. Likewise, the indicated sequence of the process steps may not always be required to achieve the intended results, but is provided for ease of illustration and description. One or more of the illustrated actions, functions, or operations may be performed repeatedly, depending on the particular strategy being used.

Finally, it will be understood that the articles, systems and methods described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. A fuel injector for an internal combustion engine, comprising:

a fuel supply channel including a nozzle opening;

a nozzle valve including a valve stem, wherein the valve stem and an inner wall of the fuel supply channel form a first region having a first flow cross section and a second region having a second flow cross section that is greater than the first flow cross section;

an actuator to actuate the nozzle valve;

a stroke limiting device to limit a stroke travel of the nozzle valve to a part stroke, the stroke limiting device including a mechanical, electromechanical or electronic additional actuating device that exerts force independent of fuel pressure to adjust the nozzle valve; and code programmed into a computer readable storage medium in an electronic control system for controlling the additional actuating device to control a position range of the part stroke of the nozzle valve differently from a position range of a full stroke of the nozzle valve, wherein the second region continues up to a step formed in the inner wall of the fuel supply channel, wherein the first region extends from the step to the nozzle opening, and wherein a closing surface of the nozzle valve is positioned in the first region during the part stroke of the nozzle valve and in the second region during the full stroke of the nozzle valve.

2. The fuel injector of claim 1, wherein the step is formed by a constriction, a recess, and/or a protrusion.

3. The fuel injector of claim 1, wherein the nozzle valve is formed as an outwardly opening or inwardly opening valve.

4. The fuel injector of claim 1, wherein the nozzle valve is actuated hydraulically by fuel pressure.

5. The fuel injector of claim 1, wherein when the closing surface of the nozzle valve is positioned in the first region, a first dynamic curve of fuel quantity throughput is predefined, and when the closing surface of the nozzle valve is positioned in the second region, a second dynamic curve is predefined that is steeper than the first dynamic curve.

6. The fuel injector of claim 1, wherein at a low opening degree of the nozzle valve, the first region limits fuel flow, and when the nozzle valve is opened further, the second region allows greater fuel flow.

7. The fuel injector of claim 1, wherein the closing surface of the nozzle valve is spherical.

8. The fuel injector of claim 1, wherein more than two flow cross sections are provided in the fuel injector.

9. The fuel injector of claim 1, wherein a required control dynamic of the fuel injector is predefined by specifying a ratio and absolute values of the first and second flow cross sections.

10. The fuel injector of claim 1, further comprising a return spring acting on the nozzle valve, and an auxiliary piston between an impact surface of the nozzle valve and the return spring.

11. A method for controlling a fuel injection quantity of a fuel injector, comprising:

providing a first fuel injection quantity from a nozzle valve of the fuel injector by actuating an outwardly-opening inner valve of the nozzle valve to enable fuel flow from a first region having a first cross-sectional area into a nozzle opening while an outwardly-opening outer valve of the nozzle valve is closed and fuel flow from a second region into the nozzle opening is not enabled, the first region formed between the inner valve and the outer valve, the second region formed between the outer valve and a fuel supply channel, and the second region having a second cross-sectional area greater than the first cross-sectional area; and providing a second fuel injection quantity greater than the first fuel injection quantity from the nozzle valve by actuating the outer valve to enable fuel flow from the second region into the nozzle opening, while the inner valve is closed and fuel flow from the first region into the nozzle opening is not enabled.

12. The method of claim 11, wherein the inner valve and/or the outer valve are actuated electronically via an actuator.

13. The method of claim 11, wherein the first fuel injection quantity is provided in response to a lower fuel flow condition, and wherein the second fuel injection quantity is provided in response to a higher fuel flow condition.

14. The method of claim 11, further comprising operating the fuel injector ballistically.

15. The method of claim 11, wherein when providing the first fuel injection quantity, the fuel injector applies a finer control, and when providing the second fuel injection quantity, the fuel injector applies a coarser, faster control.

16. The method of claim 15, further comprising providing the first fuel injection quantity during an engine idle speed or low load condition, and providing the second fuel injection quantity during a full load or full acceleration condition.

17. The method of claim 14, further comprising operating the fuel injector ballistically with a stop at each of a part stroke position and a full stroke position.

18. A fuel injector for an internal combustion engine, comprising:

an outwardly-opening outer nozzle valve forming a cavity that passes through a longitudinal axis thereof;

an outwardly-opening inner nozzle valve arranged within the cavity, the cavity having a first cross-sectional area formed between the inner nozzle valve and the outer nozzle valve;

a fuel supply channel in which the outer nozzle valve is arranged, wherein a second cross-sectional area formed between an inner wall of the fuel supply channel and the outer nozzle valve is greater than the first cross-sectional area;

a first actuator configured to actuate the inner nozzle valve independent of the outer nozzle valve while the outer nozzle valve is closed to provide a first injection quantity; and a second actuator configured to actuate the outer nozzle valve while the inner nozzle valve is closed to provide a second injection quantity greater than the first injection quality.

19. The fuel injector of claim 18, wherein the first and second actuators are further configured to actuate both the inner and outer nozzle valves to an operating position in which both valves are open.

* * * * *